US005490650A

United States Patent [19]

Pendergrass

[11] Patent Number: 5,490,650

[45] Date of Patent: Feb. 13, 1996

[54] COMBINED HANGING APPARATUS AND PEGBOARD AND METHOD FOR INSTALLING A HANGING APPARATUS ON A PEGBOARD

[76] Inventor: Frank Pendergrass, 106 N. Chariton, Kingman, Kans. 67068

[21] Appl. No.: 305,827

[22] Filed: Sep. 14, 1994

[51] Int. Cl.[6] ..... A47B 96/06

[52] U.S. Cl. ..... 248/220.31; 248/303

[58] Field of Search ..... 248/220.3, 222.3, 248/302, 303, 304; 211/57.1, 59.1, 106

[56] References Cited

U.S. PATENT DOCUMENTS

| | | | |
|---|---|---|---|
| D. 260,234 | 8/1981 | Johnson, Jr. . | |
| D. 280,596 | 9/1985 | Keeler . | |
| 1,365,508 | 1/1921 | Kucewicz | 248/303 |
| 2,208,152 | 7/1940 | Badhorn | 248/303 |
| 2,957,671 | 10/1960 | Messier . | |
| 3,037,732 | 6/1962 | Roman . | |
| 3,226,072 | 12/1965 | Johnson | 248/302 X |
| 3,310,271 | 3/1967 | King . | |
| 3,335,991 | 8/1967 | Epple | 248/303 X |
| 4,750,700 | 6/1988 | Wade . | |
| 5,054,728 | 10/1991 | Nigro, Jr. . | |
| 5,104,082 | 4/1992 | Bayer . | |

FOREIGN PATENT DOCUMENTS

| | | | |
|---|---|---|---|
| 1230757 | 5/1971 | United Kingdom | 248/302 |

*Primary Examiner*—Alvin C. Chin-Shue
*Assistant Examiner*—Derek J. Berger
*Attorney, Agent, or Firm*—John W. Carpenter

[57] ABSTRACT

A hanging apparatus in combination with a pegboard. A method for installing a hanging apparatus on a pegboard. The hanging apparatus has a helical body which passes into an aperture in the pegboard after the hanging apparatus has been rotated about 180° degrees relative to a front of the pegboard.

10 Claims, 5 Drawing Sheets

COMBINED HANGING APPARATUS AND PEGBOARD AND METHOD FOR INSTALLING A HANGING APPARATUS ON A PEGBOARD

BACKGROUND OF THE INVENTION

1. Field of the Invention

The present invention generally relates to a combination of a hanging apparatus combinedly engaged to a pegboard, and to a method for installing a hanging apparatus, such as a peghook, on a pegboard.

2. Description of the Prior Art

A patentability investigation was conducted and the following U.S. patents were discovered:

U.S. Pat. No. 2,957,671 to J. A. A. Messier;

U.S. Pat. No. 3,037,732 to D. B. Roman;

U.S. Pat. No. 3,310,271 to L. H. King;

U.S. Pat. No. 4,750,700 to Wade;

U.S. Pat. No. 5,054,728 to Nigro, Jr.;

U.S. Pat. No. 5,104,082 to Bayer;

U.S. Pat. No. Des. 260,234 to Johnson, Jr.; and

U.S. Pat. No. Des. 280,596.

U.S. Pat. No. 2,957,671 teaches a quick releasable means for holding two or more perforate wall boards or panels firmly clamped together in face to face contact by the use of two wire staying devices having jogged ends anchored in the holes of the wall board.

U.S. Pat. No. 3,037,732 teaches stabilization of peg board hangers through the use of separately formed stabilizing means, and discloses providing such a separately formed stabilizer by means of which the lower body portion of the hanger may be positively held against forward displacement with respect to the board.

U.S. Pat. No. 3,310,271 provides an apertured board having an appearance wherein an elongated slot is employed in lieu of the customary round hole. In combination therewith, a hook member having a cross member key at the end is used. The cross member is sized to fit in the elongated slot and to lock against the back of the apertured board when either angularly turned or otherwise moved relative to the aperture, thereby preventing the hook from falling out.

U.S. Pat. No. 4,750,700 teaches a hook apparatus used for hanging articles on pegboards which includes a length of plated, resilient wire bent a various points and at various angles to create a hook which requires only a single hole for tight engagement. Due to the geometrical configuration of the sections relative to the board surface and to the pegboard hole, pressing the hook into position in a single hole in a pegboard generates a spring force in the hook which is opposed by the pegboard surface and hole edges, and which holds the hook tightly in position. Although engagement in only one hole is necessary for tight engagement, the hook apparatus is taught to be of such a configuration that the hook may be engaged in an upper pegboard hole for maximum tightness, with a stabilizer bend portion engaging a next lower hole to resist side-to-side deflection.

U.S. Pat. No. 5,054,728 teaches a pegboard hanger having a pair of shoulder members to pass through apertures in the pegboard with a body extending from the shoulder members in front of the pegboard and a neck member on each shoulder member disposed behind the pegboard, with such neck members extending at an outward angle to a vertical axis to retain the hanger in the pegboard.

U.S. Pat. No. 5,104,082 teaches a chandelier hook for a chandelier trimming. The hook is disclosed as having a pair of bends, one of which is adapted for engagement with an opening in a chandelier frame and the other of which is adapted to resist accidental displacement of the trimming from the chandelier frame.

U.S. Design Pat. No. 260,234 discloses an ornamental design for a releasable hook.

U.S. Design Pat. No. 280,596 discloses an ornamental design for a security-peg board fastener.

None of the foregoing U.S. Patents teach or suggest the particular combined apparatus and method of the present invention.

SUMMARY OF THE INVENTION

The present invention accomplishes its desired objects by broadly providing a method for installing a hanging apparatus (e.g. a peghook) on a pegboard comprising the steps of:

a) providing a pegboard having a pegboard back and a pegboard front and a structure defining at least one pegboard aperture;

b) providing a hanging apparatus having a helical body integrally engaged to a neck member and having a carrier member coupled (preferably via an upright member) to the helical body, and wherein the helical body includes a first pegboard engaging helical section for engaging and generally flushing against the pegboard back and a second pegboard engaging helical section for engaging and generally flushing against the pegboard front;

c) inserting the neck member of the hanging apparatus through the pegboard aperture;

d) rotating the hanging apparatus about 180° degrees for passing the first pegboard engaging helical section through the pegboard aperture, wherein the about 180° degree rotation causes the first pegboard engaging helical section to become engaged and essentially flushed against the pegboard back and said about 180° degree rotation further causes the second pegboard engaging helical section to become engaged and essentially flushed against the pegboard front such that the hanging apparatus becomes essentially steadfastly secured to the pegboard against any upward or downward force on the carrier member.

Prior to the rotating step (d), the upright member which preferably couples the helical body with the carrier member is generally parallel to the pegboard front and disposed essentially vertically or upright above the pegboard aperture when viewed in a front elevational view; and subsequent to the rotating step (d), the upright member is generally parallel to the pegboard front and disposed essentially vertically or upright below the pegboard aperture when viewed in the front elevational view. Subsequent to the rotating step (d), the upright member is in close proximity to the pegboard. Also subsequent to the rotating step (d) the first and second pegboard engaging helical sections biasingly compress against a section of the pegboard immediately above the pegboard aperture. The rotating step (d) is counterclockwise relative to a front elevational view.

The present invention also accomplishes its desired objects by broadly providing in combination a hanging apparatus and a pegboard. The peg board has a pegboard back and a pegboard front and a pegboard structure defining at least one pegboard aperture. The hanging apparatus (or peghook) is steadfastly rotatively secured to the pegboard. The hanging apparatus has a helical body extending into the pegboard aperture and integrally engaged or secured to a neck member and to an upright member. A carrier member is integrally engaged to or secured to the upright member. The helical body includes a first pegboard engaging helical section engaged and essentially flushed against the pegboard back and a second pegboard engaging helical section engaged and essentially flushed against the pegboard front such that the first pegboard engaging helical section and the second pegboard engaging helical section generally sandwiches (or biasingly compresses with a spring-like force) a section of the pegboard therebetween in order that the hanging apparatus becomes generally steadfastly secured to the pegboard against any upward or downward force on the carrier member. The biasingly compressed section of the pegboard may be at any suitable location on the pegboard, but is preferably in close proximity to the pegboard aperture, more preferably above the pegboard aperture.

It is therefore an object of the present invention to provide a method for installing a hanging apparatus (e.g. a peghook) on a pegboard.

It is another object of the present invention to provide in combination a hanging apparatus rotatively and/or removably secured to a pegboard.

These, together with the various ancillary objects and features which will become apparent to those skilled in the art as the following description proceeds, are attained by this novel combined hanging apparatus and pegboard and method for installing a hanging apparatus on a pegboard, a preferred embodiment being shown with reference to the accompanying drawings, by way of example only, wherein:

BRIEF DESCRIPTION OF THE DRAWINGS

FIG. 23 is a front elevational view of the embodiment of the peghook in FIG. 22;

DETAILED DESCRIPTION OF THE PRESENT INVENTION

Figure 1:
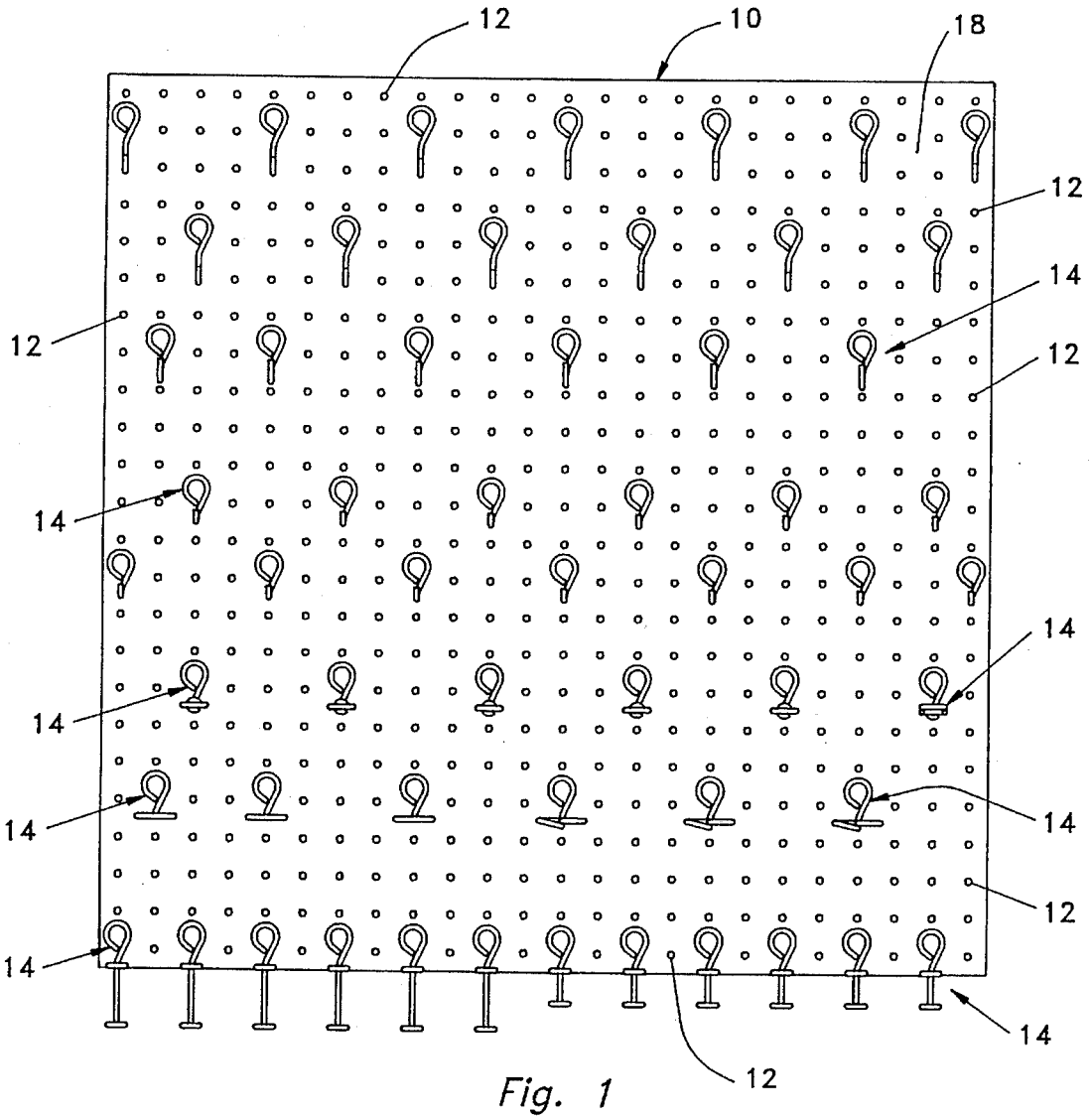
FIG. 1 is a front elevational view of a pegboard containing pegboard apertures and having a plurality of peghooks secured thereto.

Referring in detail now to the drawings wherein similar parts of the present invention are identified by like reference numerals, there is seen a pegboard, generally illustrated as having a plurality of apertures or pegholes 12 for receiving one or more (i.e. at least one) peghooks (or hanging apparatus), generally illustrated as 14. The pegboard 10 has a back (surface) 16 and a front (surface) 18.

The peghooks 14 have various embodiments. In the preferred embodiments of the peghook 14 depicted in FIGS. 2–15, the peghook 14 (or hanging apparatus) has a spiral or helical body, generally illustrated as 20. The helical body 20 opposedly terminates in a neck member 22 and is coupled to a carrier member 26, preferably via a generally upright member 24. Stated alternatively, the neck member 22 and the upright member 24 are integrally secured to the helical body 20 in an opposed relationship. The neck member 22 defines an angled tip or a protruding stub end. A carrier member 26 for carrying or holding or hanging any article (e.g. screw drivers, pliers, bags, display cards, various assembly tools or other assembly articles in commerce, etc.) for any use is coupled to the upright member preferably by being integrally engaged to or connected to the upright member 24 which in turn is integrally secured to the helical body 20.

The helical body 20 has a pair of general helical sections 30 and 32 which terminate in each other. The general helical sections 30 and 32 are continuous in each other such that a dividing point 80 (see FIG. 8) from and/or between the two helical sections 30 and 32 is generally approximate. Helical section 30 is for engaging and generally flushing against the back 16 of the pegboard 10. When the peghook 14 is releasably engaged to and against the pegboard 10, helical section 30 is engaged against and/or is essentially flushed against the back 16. Similarly, helical section 30 is for engaging and generally flushing against the back 16 of the pegboard. When the peghook 14 is releasably engaged to and against the pegboard 10, helical section 32 is engaged against and/or is essentially flushed against the front 18.

Figure 8:
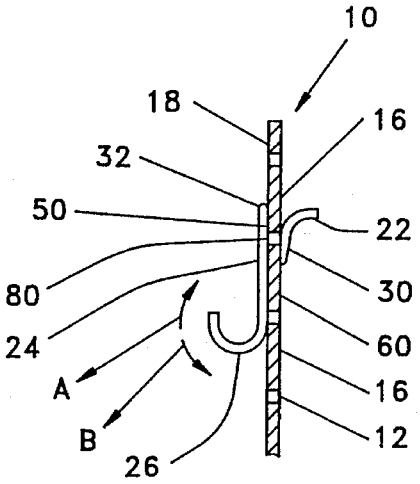
FIG. 8 is a side elevational view of the peghook and the pegboard after the peghook in FIG. 7 has been rotated another about 90° degrees.

As best shown in FIG. 8, helical section 30 and helical section 32 sandwich (or slightly compress) together a section 50 of the pegboard 10 immediately above the aperture 12 wherein and partly wherethrough the helical body 20 passes. Stated alternatively, the helical body 20 passes into one of the apertures 12 such that helical section 30 (due to the spring like or resilient like material (e.g. wire) from which the peghook 14 is constructed from or of) biasingly, compressingly engages the back (which is part of the back 16 of the pegboard 10) of section 50 (which is immediately above or in close proximity to the helical-body-receiving aperture 12), and helical section 32 biasingly, compressingly engages the front (which is part of the front 18 of the pegboard 10) of section 50. Because helical sections 30 and 32 are spaced apart (see FIG. 8) in such a degree and/or at a measurement, which is slightly less than the thickness of the section 50 of the pegboard 10, such a biasingly, compressingly arrangement is possible; and the biasingly, compressingly arrangement enables the hanging apparatus or peghook 14 to be generally steadfastly or generally fixedly secured to the pegboard 10 (more particularly to section 50 of the pegboard 10) against any upward force (more specifically against any upward arcuate moving force as generally represented by arrow A in FIG. 8) or any downward force (more specifically against any downward arcuate moving force as generally represented by arrow B in FIG. 8) on the carrier member 26.

Figure 9:
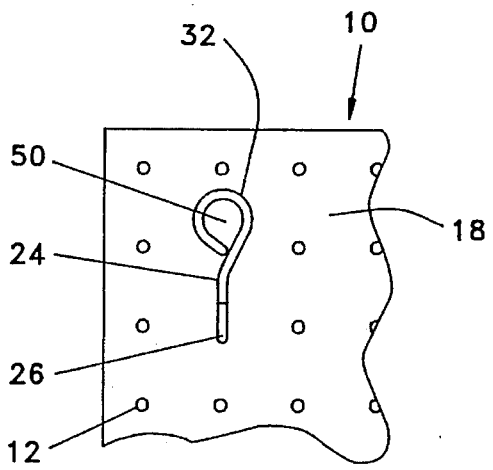
FIG. 9 is a front elevational view of the peghook and pegboard of FIG. 8.
Figure 10:
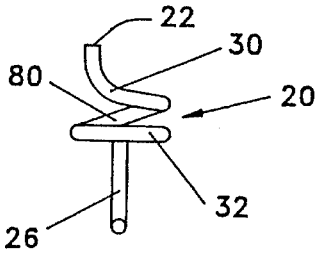
FIG. 10 is a top plan view of the peghook in FIG. 2.
Figure 13:
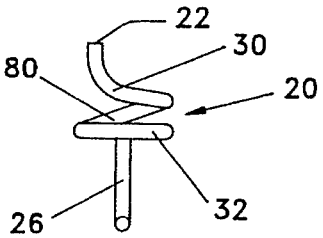
FIG. 13 is a top plan view of another embodiment of the peghook.
Figure 11:
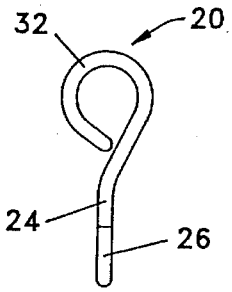
FIG. 11 is a front elevational view of the peghook in FIG. 10.
Figure 12:
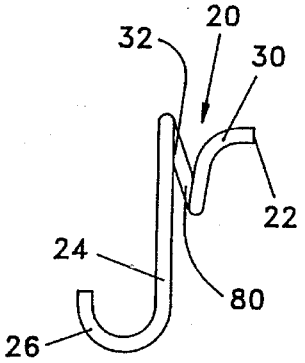
FIG. 12 is a side elevational view of the peghook in FIG. 10.
Figure 14:
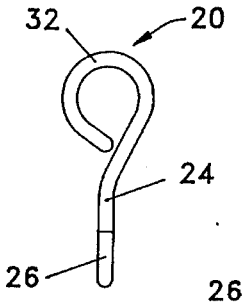
FIG. 14 is a front elevational view of the embodiment of the peghook in FIG. 13.
Figure 15:
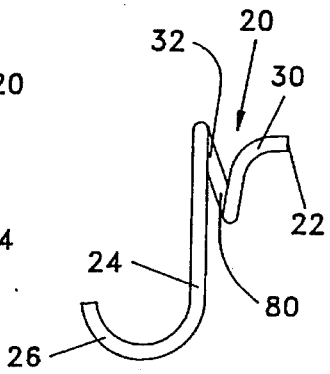
FIG. 15 is a side elevational view of the embodiment of the peghook in FIG. 13.
Figure 16:
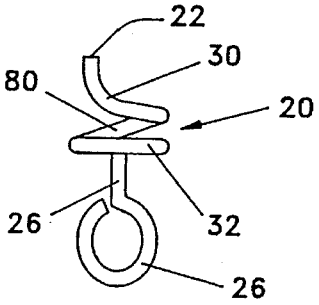
FIG. 16 is a top plan view of yet another embodiment of the peghook.
Figure 19:
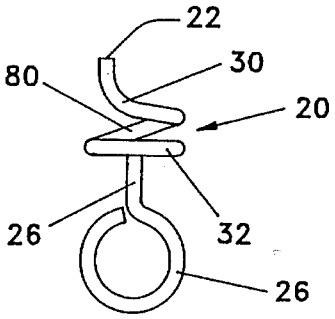
FIG. 19 is a top plan view of another embodiment of the peghook.
Figure 17:
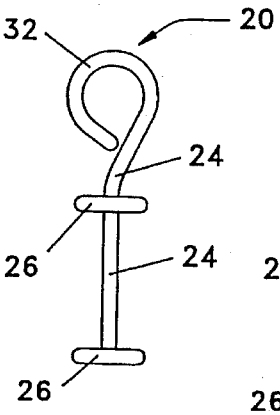
FIG. 17 is a top plan view of the embodiment of the peghook in FIG. 16.
Figure 18:
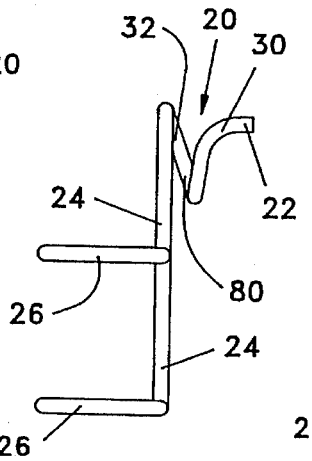
FIG. 18 is a side elevational view of the embodiment of the peghook in FIG. 16.
Figure 20:
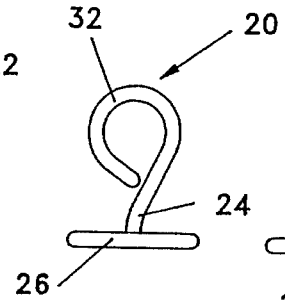
FIG. 20 is a front elevational view of the embodiment of the peghook in FIG. 19.
Figure 21:
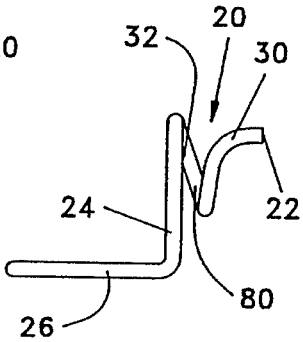
FIG. 21 is a side elevational view of the embodiment of the peghook in FIG. 19.

While the stated peghook 14 may not be moved upwardly or downwardly to produce a loosely fitting peghook 14 that easily falls off of the pegboard 10, it may be rotated in a desired direction, such as clockwise in FIGS. 8 and 9 for removing the stated peghook 14 from the stated or helical-body-receiving aperture 12. As further shown in FIG. 8, when the peghook 14 has been postured in the desired position, which is after the peghook 14 has been rotated about 180° degrees relative to the peghook's front elevational position in FIG. 5, the upright member 24 of the peghook 14 is in proximity to the pegboard 10, more specifically in close proximity to a section 60 of the pegboard 10 below (preferably immediately below) the above-stated aperture 12.

By "close proximity" it is to be understood and interpreted broadly such as to have the upright member 24 not necessarily touching but postured immediately off or away from the surface 60 of the front 18, preferably postured immediately off or away from the surface 60 of the front 18 such that if the carrier member 26 is weighted with an article, the upright member 24 is capable of engaging the front 18, more particularly section 60 of the pegboard 10, to further assist helical section 30 and 32 of the helical body 20 in maintaining the peghook 14 essentially steadfastly and/or fixedly secured to the pegboard 10, especially against any upwardly or downwardly movement or force (particularly on or against the carrier member 26) for loosening the peghook 14 within the above-stated particular aperture 12 which could cause the subject peghook 14 to fall off of the pegboard 10. By "close proximity" it is to also be understood and is to be broadly interpreted such as to have the upright member 24 also or essentially flushed and/or engaged to or against the front 18 which is preferably proximately located to the above-stated aperture 12, more preferably located immediately below the above-stated aperture 12 and opposed (i.e. diametrically opposed) relative to the section 50 with respect to the above-stated aperture 12.

Figure 22:
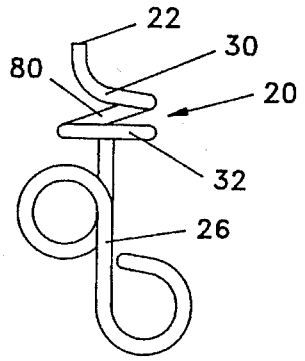
Figure 25:
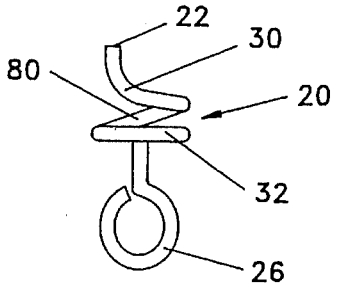
FIG. 25 is a top plan view of a further embodiment of the peghook.
Figure 23:
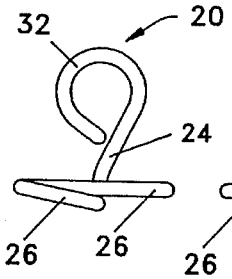
FIG. 23 is a top plan view of still yet another embodiment of the peghook.
Figure 24:
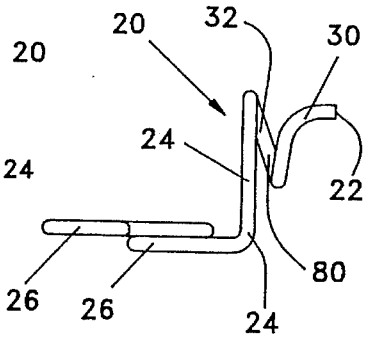
FIG. 24 is a side elevational view of the embodiment of the peghook in FIG. 22.
Figure 26:
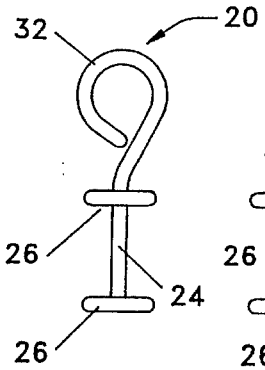
FIG. 26 is a front elevational view of the embodiment of the peghook in FIG. 25.
Figure 27:
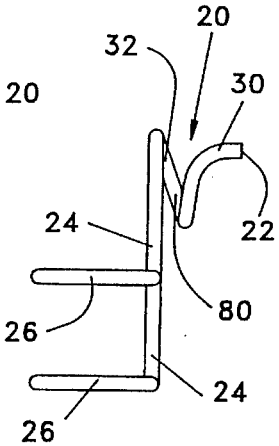
FIG. 27 is a side elevational view of the embodiment of the peghook in FIG. 25.
Figure 28:
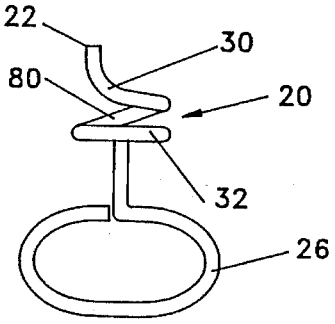
FIG. 28 is a top plan view of another further embodiment of the peghook.
Figure 31:
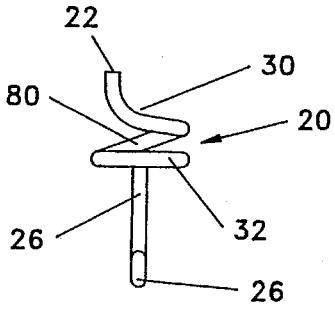
FIG. 31 is a top plan view of yet another further embodiment of the peghook.
Figure 29:
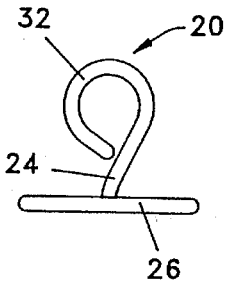
FIG. 29 is a front elevational view of the embodiment of the peghook in FIG. 28.
Figure 30:
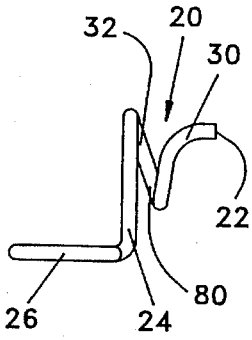
FIG. 30 is a side elevational view of the embodiment of the peghook in FIG. 28.
Figure 32:
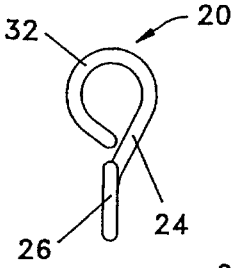
FIG. 32 is a front elevational view of the embodiment of the peghook in FIG. 31.
Figure 33:
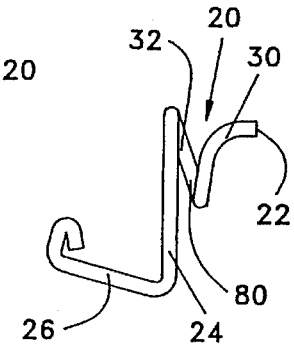
FIG. 33 is a side elevational view of the embodiment of the peghook in FIG. 31.
Figure 34:
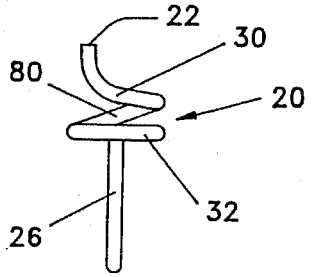
FIG. 34 is a top plan view of still yet another further embodiment of the peghook.
Figure 37:
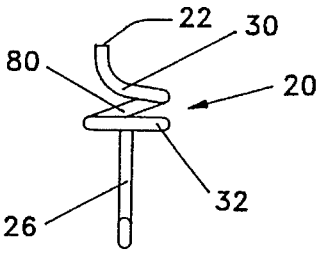
FIG. 37 is a top plan view of yet another further embodiment of the peghook.
Figure 35:
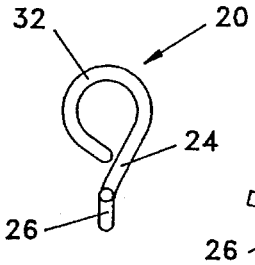
FIG. 35 is a side elevational view of the embodiment of the peghook in FIG. 34.
Figure 36:
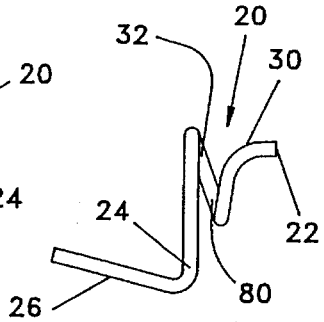
FIG. 36 is a side elevational view of the embodiment of the peghook in FIG. 34.
Figure 38:
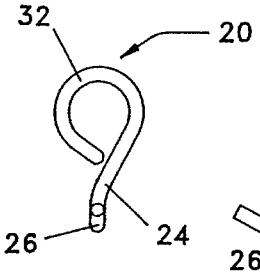
FIG. 38 is a front elevational view of the embodiment of the peghook in FIG. 37.
Figure 39:
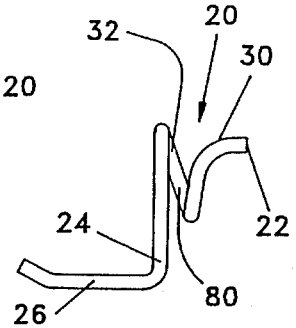
FIG. 39 is a side elevational view of the embodiment of the peghook in FIG. 37.
Figure 40:
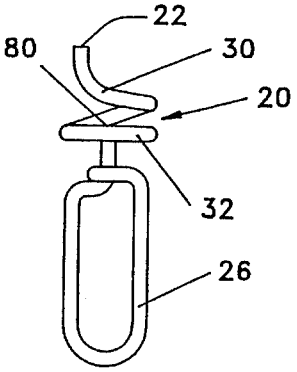
FIG. 40 is a top plan view of still yet another further embodiment of the peghook.
Figure 43:
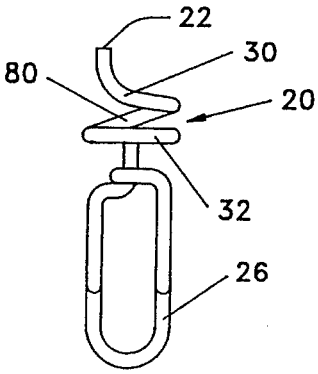
FIG. 43 is a top plan view of yet another preferred embodiment of the peghook.
Figure 41:
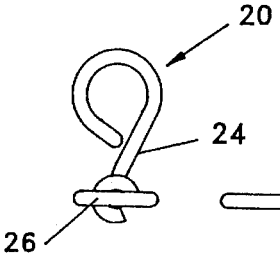
FIG. 41 is a front elevational view of the embodiment of the peghook in FIG. 40.
Figure 42:
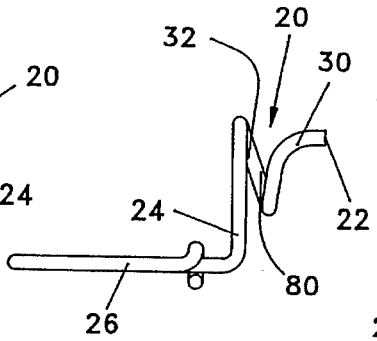
FIG. 42 is a side elevational view of the embodiment of the peghook in FIG. 40.
Figure 44:
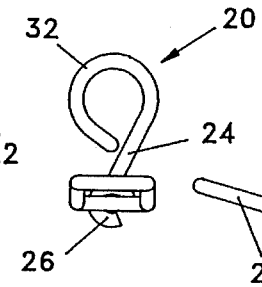
FIG. 44 is a front elevational view of the embodiment of the peghook in FIG. 43.
Figure 45:
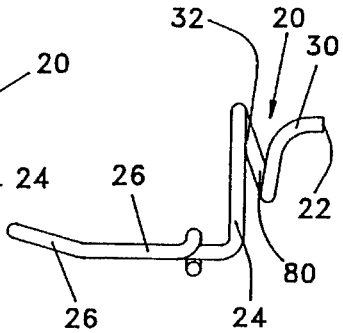
FIG. 45 is a side elevational view of the embodiment of the peghook in FIG. 43.

As was previously mentioned, the peghook 14 has various preferred embodiments. For the preferred embodiments illustrated in FIGS. 16–33, the feature that distinguishes each preferred embodiment over the remaining preferred embodiments is the various embodiments of the carrier member 26. For the preferred embodiment of the peghook 14 depicted in FIGS. 2–15, the carrier member 26 is formed by or with an arcuate-like structure. In FIGS. 16–18 and FIGS. 25–27, the carrier member 26 consists of a pair of spaced circular-like structures. The carrier member 26 for the preferred embodiment of the peghook in FIGS. 19–21 and FIGS. 28–30 consist of a single circular-like or generally elliptical structure. In FIGS. 22–24 the carrier member 26 is seen to be a FIG. 8-like structure. In another preferred embodiment of the peghook 14 as shown in FIGS. 31–39, the carrier member 26 is seen to be either acutely angularly disposed relative to the upright member 24 or (as seen in FIGS. 31–33) terminating in an askewed structure, or (as shown in FIGS. 37–39) generally normally postured with respect to the upright member 24 and terminating in an upwardly angled tip-like structure. In the remaining preferred embodiment for the peghook 14 and as illustrated in FIG. 40–45, the carrier member 26 possesses an elongated-like opening, with the elongated-like opening being deformed and skewed or bent upwardly as shown in FIGS. 43–45.

Figure 2:
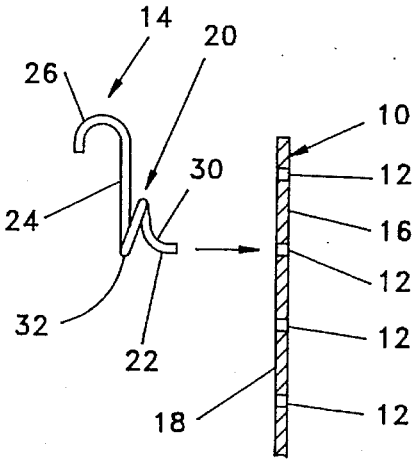
FIG. 2 is a side elevational view of a peghook having its associated neck member approaching an aperture in the pegboard.
Figure 3:
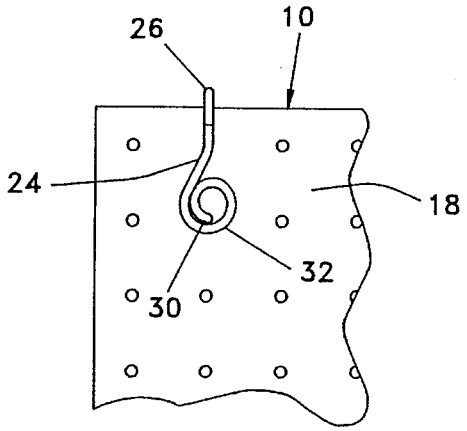
FIG. 3 is a partial front elevational view of a section of the pegboard and the peghook of FIG. 2 after the neck member has slidably passed into an aperture (i.e. a peghook aperture) of the pegboard.
Figure 4:
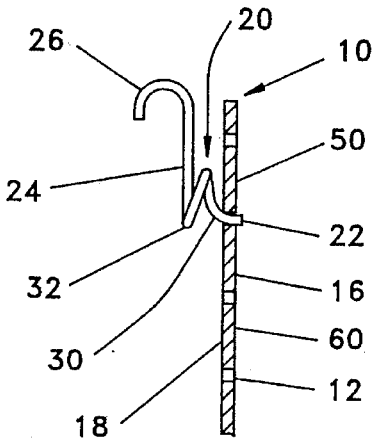
FIG. 4 is a side elevational view of the peghook and pegboard of FIG. 3.
Figure 5:
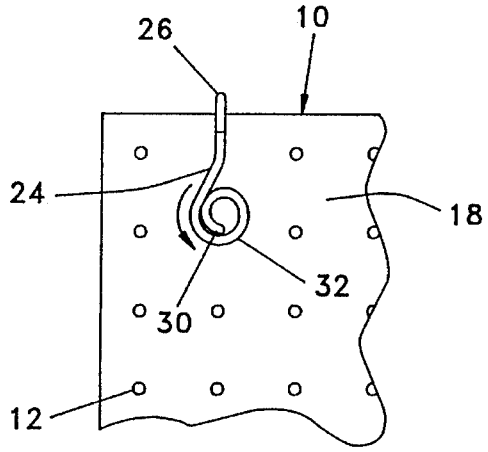
FIG. 5 is a front elevational view of the peghook and pegboard of FIG. 4 with an arrow indicating that the peghook is to be rotated counterclockwise relative to the front elevational view.
Figure 6:
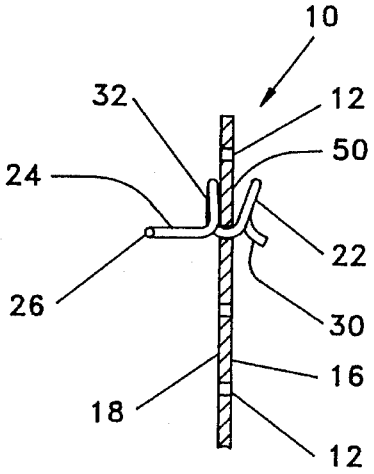
FIG. 6 is a side elevational view of the peghook and the pegboard after the peghook in FIG. 5 has been rotated about 90° degrees.
Figure 7:
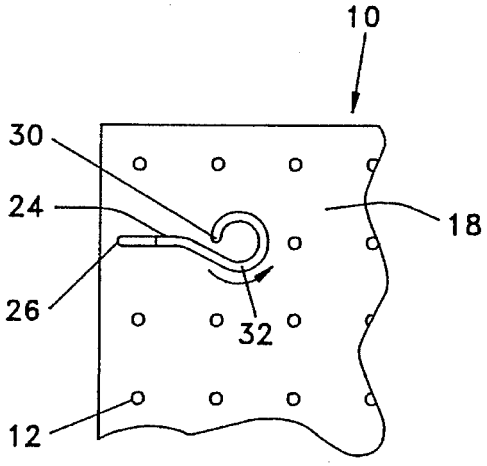
FIG. 7 is a front elevational view of the peghook and pegboard of FIG. 6 with an arrow indicating that the peghook is to be further rotated counterclockwise.

Continuing to refer in detail to the drawings for operation of the invention and the method for installing the peghook 14 on the pegboard 10, any one of the various embodiments of the peghook 14 is grasped and held suspendidly such that the neck member 22 is generally aligned with one of the apertures 12 as best shown in FIG. 2. The associated neck member 22 of the pegboard 14 is inserted into the aperture 12 (see FIG. 4). When the peghook 14 has an initial disposition of having its associated neck member 22 initially inserted into the aperture 12, the associated upright member 24 is generally parallel to the facial plane of the front 18 of the pegboard 10 and is essentially upright or vertically above the neck-received aperture 12 when viewed in a front elevational view, such as the front elevational view in FIG. 5. From the peghook's 14 position in FIG. 5, the stated peghook 14 is subsequently rotated (i.e. a counterclockwise rotation) about 180° degrees for passing (rotatably) the helical section 30 through the stated aperture (see FIGS. 6–9). The approximate 180° degree rotation may be done in two (2) stages such as an initial approximate 90° degree rotation as best shown in FIGS. 6 and 7, and then a subsequent approximate 98° degree rotation as best shown in FIGS. 8 and 9. As was previously mentioned, the approximate 180° degree rotation causes the helical section 30 to become engaged and essentially flushed against the pegboard back 16 (more specifically against the back of section 50), and further causes the helical section 32 to become engaged and essentially flushed against the pegboard front 18 (more specifically against the front of the section such that the stated pegboard 14 becomes steadfastly rotatably secured to the pegboard 10, especially against any upward or downward force on the carrier member 26. After the peghook 14 has made the approximate 180° degree rotation, the associated upright member 24 is generally parallel to the facial plane of the front 18 of the pegboard 10 and is essentially upright or vertically below the addressed and stated aperture 12 when viewed in a front elevational view, such as the front elevational view in FIG. 9. After installation, the approximate dividing point is situated in or circumscribed by the stated aperture 12 as best shown in FIG. 8. If the stated peghook 14 is to be removed the procedure is reversed; more specifically, the stated peghook 14 is rotatively reversed about 180° degrees in a direction opposite to the installation direction, such as clockwise with respect to the front elevational view in FIG. 9. The approximate 180° degree opposite rotational (clockwise) direction causes the helical section 30 to move out from behind the pegboard 10 and pass through the stated aperture 12 for the subsequent withdrawal of the neck 22 out of the same stated aperture.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for installing a hanging apparatus on a pegboard comprising the steps of:

a) providing a pegboard having a pegboard back and a pegboard front and a structure defining at least one pegboard aperture;

b) providing a hanging apparatus having a neck member, a helical body integrally engaged to said neck member and having a carrier member coupled to the helical body, and wherein said helical body includes a first pegboard engaging helical section for engaging and generally flushing against the pegboard back and a second pegboard engaging helical section for engaging and generally flushing against the pegboard front;

c) inserting the neck member of the hanging apparatus through the pegboard aperture;

d) rotating the hanging apparatus about 180° degrees for passing the first pegboard engaging helical section through the pegboard aperture, wherein said about 180° degree rotation causes the first pegboard engaging helical section to become engaged and essentially flushed against the pegboard back and further causes the second pegboard engaging helical section to become engaged and essentially flushed against the pegboard front such that the hanging apparatus becomes steadfastly secured to the pegboard against any upward or downward force on the carrier member.

2. The method of claim 1 additionally comprising an upright member secured integrally to said carrier member and to said helical body for coupling the helical body to the carrier member, and wherein prior to said rotating step (d), said upright member is generally parallel to the pegboard front and is generally disposed vertically above the pegboard aperture when viewed in a front elevational view; and subsequent to said rotating step (d), said upright member is generally disposed vertically below the pegboard aperture when viewed in the front elevational view.

3. The method of claim 2 wherein subsequent to said rotating step (d), said upright member is in close proximity to said pegboard.

4. The method of claim 3 wherein said rotating step (d) is counterclockwise relative to a front elevational view.

5. The method of claim 3 wherein subsequent to said rotating step (d), said first pegboard engaging helical section and said second pegboard engaging helical section biasingly compress against a section of the pegboard immediately above the pegboard aperture of step (c).

6. The method of claim 2 wherein said rotating step (d) is counterclockwise relative to a front elevational view.

7. The method of claim 2 wherein subsequent to said rotating step (d), said first pegboard engaging helical section and said second pegboard engaging helical section biasingly compress against a section of the pegboard immediately above the pegboard aperture of step (c).

8. The method of claim 1 wherein said rotating step (d) is counterclockwise relative to a front elevational view.

9. The method of claim 1 wherein subsequent to said rotating step (d), said first pegboard engaging helical section and said second pegboard engaging helical section biasingly compress against a section of the pegboard immediately above the pegboard aperture of step (c).

10. In combination a hanging apparatus and a pegboard comprising;

a) a peg board having a pegboard back and a pegboard front and a pegboard structure defining at least one pegboard aperture;

b) a hanging apparatus steadfastly rotatively secured to said pegboard; said hanging apparatus having a neck member, a helical body extending into said pegboard aperture and integrally engaged to said neck member and having a carrier member coupled to said helical body and wherein said helical body includes a first pegboard engaging helical section engaged and essentially flushed against the pegboard back and a second pegboard engaging helical section engaged and essentially flushed against the pegboard front such that said first pegboard engaging helical section and said second pegboard engaging helical section generally sandwiches a section of the pegboard therebetween in order that the hanging apparatus becomes steadfastly secured to the pegboard against any upward or downward force on the carrier member.

* * * * *